US009520672B2

(12) United States Patent
Horstmann et al.

(10) Patent No.: US 9,520,672 B2
(45) Date of Patent: Dec. 13, 2016

(54) CLOSING CAP FOR A PLUG-AND-SOCKET CONNECTOR

(71) Applicant: HARTING Electric GmbH & Co. KG, Espelkamp (DE)

(72) Inventors: Jens Horstmann, Espelkamp (DE); Bernard Schlegel, Rahden (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 14/894,183

(22) PCT Filed: May 6, 2014

(86) PCT No.: PCT/DE2014/100158
§ 371 (c)(1),
(2) Date: Nov. 25, 2015

(87) PCT Pub. No.: WO2015/003685
PCT Pub. Date: Jan. 15, 2015

(65) Prior Publication Data

US 2016/0111810 A1 Apr. 21, 2016

(30) Foreign Application Priority Data

Jul. 10, 2013 (DE) ..... 10 2013 107 282

(51) Int. Cl.
*H01R 13/44* (2006.01)
*H01R 13/52* (2006.01)
(Continued)

(52) U.S. Cl.
CPC ..... *H01R 13/5213* (2013.01); *H01R 13/465* (2013.01); *H01R 13/625* (2013.01)

(58) Field of Classification Search
CPC ..... H01R 13/447
(Continued)

(56) References Cited

U.S. PATENT DOCUMENTS 3,987,930 A * 10/1976 Fuson ..... A61M 39/20 138/89
4,678,867 A 7/1987 Bongard et al. ..... 174/135
(Continued)

FOREIGN PATENT DOCUMENTS

DE 1 043 449 11/1958 ..... H01R 13/621
DE 79 02 688 6/1979 ..... H01R 13/44
(Continued)

OTHER PUBLICATIONS

International Preliminary Report on Patentability issued in application No. PCT/DE2014/100158, dated Jan. 21, 2016 (9 pgs).

*Primary Examiner* — Phuong Dinh
(74) *Attorney, Agent, or Firm* — Hayes Soloway P.C.

(57) ABSTRACT

Disclosed is a closing cap for media-tight sealing of a plug face of a plug-and-socket connector, in particular a round plug-and-socket connector, wherein the closing cap can be detachably fixed to a plug-and-socket connector housing, wherein the closing cap is configured, such that a further closing cap of identical construction can be detachably fixed to the closing cap. The closing caps can be stored, for example stacked one on top of the other, on a plug-and-socket connector housing in a switchgear cabinet. This simplifies storage in that when a closing cap is removed from one connector it may be stored on a closing cap of an adjacent connector.

14 Claims, 3 Drawing Sheets

(51) Int. Cl.
*H01R 13/46* (2006.01)
*H01R 13/625* (2006.01)

(58) Field of Classification Search
USPC ..... 439/135, 136, 149
See application file for complete search history.

(56) References Cited

U.S. PATENT DOCUMENTS

| | | | | |
|---|---|---|---|---|
| 5,350,204 | A | 9/1994 | Henniger | 285/323 |
| 6,682,358 | B1 * | 1/2004 | Morris | H01R 13/523 439/135 |
| 7,214,075 | B2 * | 5/2007 | He | H01R 13/5213 439/135 |
| 2005/0191882 | A1 | 9/2005 | Torii et al. | 439/98 |
| 2007/0036489 | A1 | 2/2007 | Grzegorzewska et al. | 385/88 |

FOREIGN PATENT DOCUMENTS

| | | | |
|---|---|---|---|
| DE | 83 36 012 | 3/1984 | H01R 13/447 |
| DE | 3725467 | 6/1988 | H01B 17/58 |
| DE | 4215635 | 11/1993 | F16L 5/08 |
| DE | 202010013211 | 3/2012 | H01R 13/52 |
| EP | 0762561 | 3/1997 | B60D 1/62 |

* cited by examiner

CLOSING CAP FOR A PLUG-AND-SOCKET CONNECTOR

BACKGROUND OF THE INVENTION

The invention relates to a closing cap for the media-tight sealing of a plug face of a plug-and-socket connector.

The invention relates to a closing cap for the media-tight sealing of a plug face of a plug-and-socket connector as claimed in the preamble of claim 1.

Closing caps of this type protect the plug face of an uninserted plug-and-socket connector against the infiltration of media, such as dust and water.

BRIEF DESCRIPTION OF THE PRIOR ART

DE 83 36 012 U1 presents a closing cap for a round plug-and-socket connector. For coding purposes, the housing of the plug-and-socket connector has a radially protruding rib. The closing cap on the inner side has a groove, which is slid over the rib protruding radially from the plug-and-socket connector housing.

The closing cap of DE 83 36 012 U1 fits the structural circumstances of the plug-and-socket connector housing, however the plug face of the plug-and-socket connector may not be protected sufficiently against media such as dust and water.

DE 79 02 688 U1 presents a covering cap for a round plug socket. The covering cap may be fixed reversibly to the plug socket with the aid of a union nut.

DE 1 043 449 A presents a round plug-and-socket connector having a watertight closing cap 44 for sealing the plug when not in use.

SUMMARY OF THE INVENTION

The object of the invention lies in proposing a reliable closing cap for a plug-and-socket connector housing.

The closing cap proposed here is used for the media-tight sealing of a plug face of a plug-and-socket connector. Here, media-tight means, for example, that no dust and/or water (moisture) can infiltrate the interior of the plug-and-socket connector housing via the plug face.

The closing cap according to the invention is particularly suitable for round plug-and-socket connectors. However, the principle of the invention can also be transferred to plug-and-socket connectors having a rectangular plug face.

The closing cap is fixed detachably to the plug-and-socket connector housing. It is fitted on whenever the plug-in connection of the plug-and-socket connector is separated. The plug face, as already explained sufficiently above, should be protected as a result. It is completely irrelevant which contact elements are comprised by the plug-and-socket connector. Electrical, pneumatic and optical signals are practically equally susceptible to soiling and/or deposits of media. Before the plug-and-socket connector is inserted again or for the first time, the closing cap is removed and may preferably be re-used the next time.

The invention lies in providing the closing cap with means such that a further closing cap of identical construction can be detachably fixed to the closing cap. These 'contacting means' are of identical construction to those on the plug-and-socket connector housing.

The closing cap has an open locking side and a closed contact side. Part of the housing body of the plug-and-socket connector housing is inserted into the opening of the locking side. The locking side has suitable means for fixing the closing cap reversibly, but captively, to the plug-and-socket connector housing. This is preferably achieved via a rotary movement in accordance with the bayonet principle. The plug-and-socket connector housing is now sealed via the closed contact side with respect to the infiltration of media. On the contact side of the closing cap, means are molded on externally, which enable a connection of the closing cap to a further closing cap of identical construction. In the case of a round plug-and-socket connector the outer radius in the plug-in region of the plug-and-socket connector housing corresponds to the outer diameter of the contact side of the closing cap in the region of the means just mentioned.

The above-described function of the closing cap is then expedient for example when the closing cap is removed from an adjacent plug-and-socket connector in order to insert said connector, and this closing cap can be fitted onto an uninserted plug-and-socket connector with closing cap. The closing cap therefore does not become lost. In addition, a more flexible, space-saving storage is possible as a result. All plug-and-socket connectors of a switchgear cabinet could be provided as standard with two closing caps fitted one on top of the other. If one protective cap becomes lost, an individual closing cap can be removed from an adjacent plug-and-socket connector and used.

The closing cap preferably has substantially the form of two cylinders placed one over the other. The cylinders substantially form what is known as a locking cylinder and what is known as a docking cylinder having a baseplate. The main axes of symmetry of the cylinders are aligned with one another. The locking cylinder forms the above-mentioned locking side, and the docking cylinder forms the closed contact side. The locking cylinder can be fixed to a plug-and-socket connector housing and equally to a docking cylinder of a closing cap of approximately identical construction.

The outer diameter of the locking cylinder is greater than the outer diameter of the docking cylinder. The outer diameter of the docking cylinder corresponds substantially to the outer diameter of the plug-and-socket connector housing in the contact region of the closing cap. Due to the different diameters, the above-described advantageous functionality of the closing cap is possible for the first time.

In a particularly advantageous embodiment of the invention the closing cap has a seal. The seal is arranged for example in a peripheral groove provided for this purpose inside the closing cap. In the locking position of the closing cap the seal is pressed against the housing wall of the plug-and-socket connector housing extending peripherally on the plug side, whereby the plug face is sealed optimally against media such as dust and water. The functionality of the closing cap remains intact for a long time as a result of the seal. A closing cap without seal would no longer be suitable as a media-tight seal after just a few occasions of use, and would for example serve merely as a protective cap for electrical contacts.

The bayonet closure ensures that precisely the force necessary for an optimal sealing function is exerted onto the seal. In the case of a screw closure the force would vary too significantly, which would either reduce the tightness or would load the seal too heavily or even damage the seal.

The closing cap is advantageously manufactured from plastic. It can thus be produced economically. A transparent plastic is particularly advantageous since the contact type of the plug-and-socket connector (pin or socket) can thus be identified without removing the closing cap.

Is also advantageous when closing caps of different colors or having different color markings are produced. In this case the colored marking or the color could characterize the type of contacts in the plug-and-socket connector.

BRIEF DESCRIPTION OF THE DRAWINGS

An exemplary embodiment of the invention is illustrated in the drawings and will be explained in greater detail hereinafter. In the drawings.

DETAILED DESCRIPTION OF THE INVENTION

Figure 1:
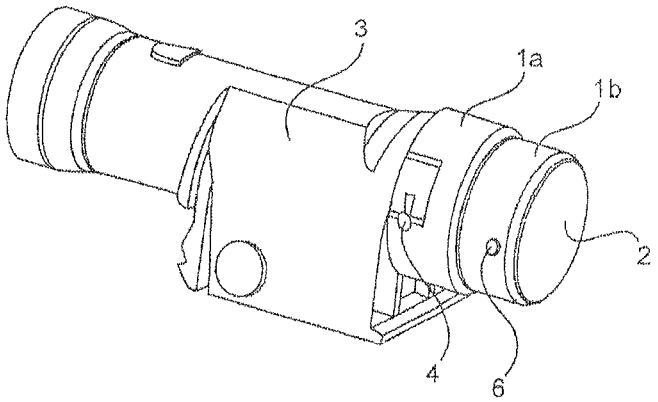
FIG. 1 shows a perspective illustration of a plug-and-socket connector housing with a fitted-on closing cap.
Figure 3:
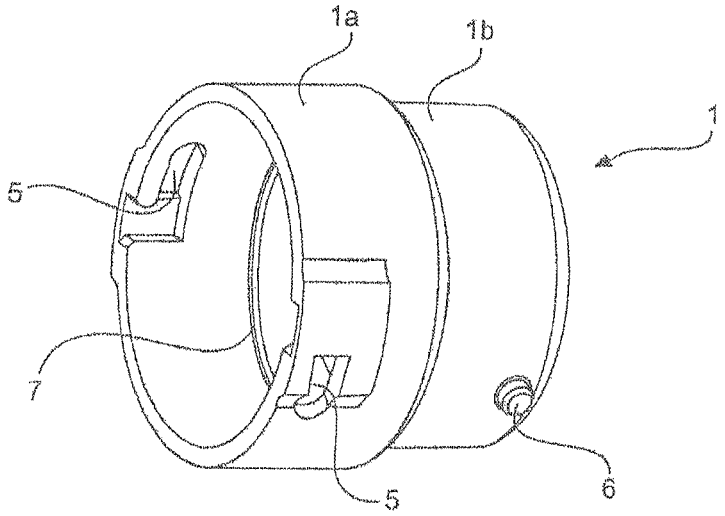
FIG. 3 shows a perspective illustration of the closing cap
Figure 4:
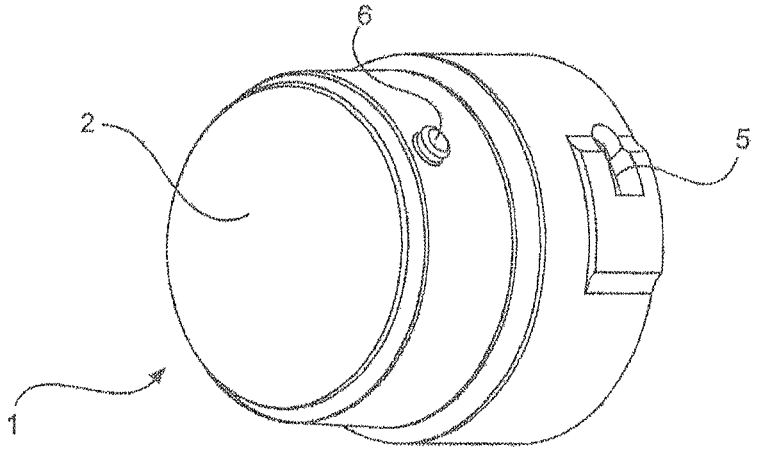
FIG. 4 shows a further perspective illustration of the closing cap.

FIG. 1 shows a plug-and-socket connector or a plug-and-socket connector housing 3 with fitted-on closing cap 1. The closing cap 1 can be seen in different perspective illustrations in FIGS. 3 and 4. The plug-and-socket connector housing 3 has a locking pin 4. The closing cap 1 has conical recesses 5, which cooperate with the locking pins 4 in accordance with the bayonet principle, whereby the closing cap 1 is fixed captively—and in a manner exerting a defined contact pressure onto the plug face—to the plug-and-socket connector housing 3.

The closing cap 1 is substantially cylindrical, wherein a constriction can be seen approximately centrally, which separates two regions from one another: the locking region and the contact region. The locking region is formed by a locking cylinder 1*a*, and the contact region is formed by a docking cylinder 1*b*. The inner diameter of the locking cylinder 1*a* corresponds to the outer diameter of the docking cylinder 1*b* and the outer diameter of the plug-and-socket connector housing 3 in the region of the locking pins 4.

Figure 2:
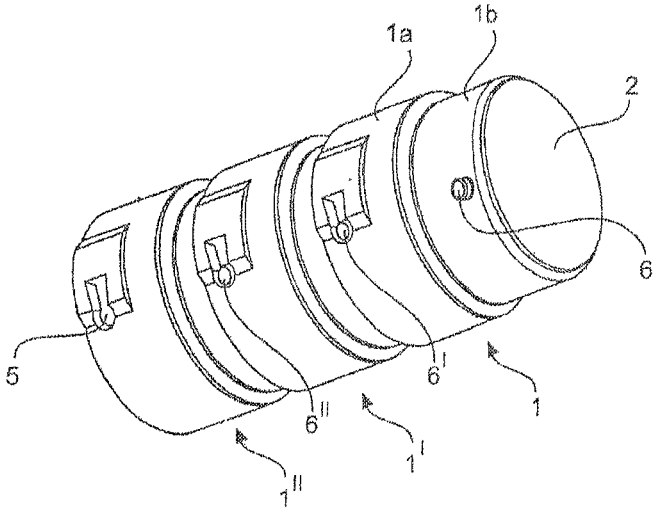
FIG. 2 shows a perspective illustration of three closing caps stacked one on top of the other.

The closing cap 1 has locking pins 6, which likewise may cooperate with the conical recesses 5 of a closing cap 1' in accordance with the bayonet principle. A stacking function of the closing caps 1, 1', 1" according to FIG. 2 can thus be achieved.

Figure 5:
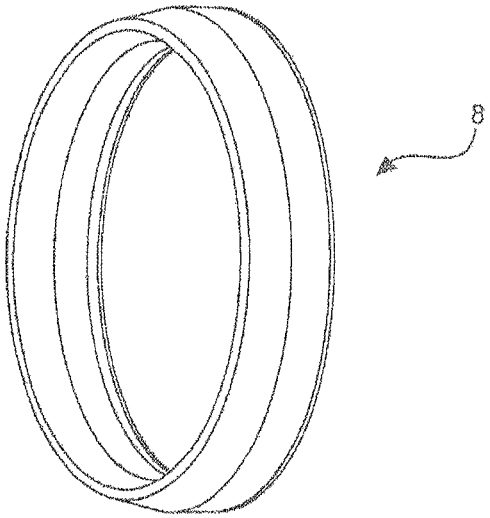
FIG. 5 shows a seal, which can be inserted into the closing cap.

A seal 8 tapering conically can be seen in FIG. 5, which is inserted into a groove 7 inside the closing cap. The cone shape is directed against the fitting direction, whereby an optimal sealing function of the closing cap 1 is achieved.

LIST OF REFERENCE SIGNS

1 closing cap
- 1*a* locking cylinder
- 1*b* docking cylinder

2 baseplate
3 plug-and-socket connector housing
4 locking pin
5 conical recess
6 locking pin
7 groove
8 seal

The invention claimed is:

1. A closing cap for media-tight sealing of a plug face of a round plug-and-socket connector, wherein the closing cap is adapted to be detachably fixed to a plug-and-socket connector housing, wherein the closing cap is configured, such that a further closing cap of identical construction can be detachably fixed to the closing cap the closing cap has the form of two cylinders placed one over the other, which substantially form a locking cylinder and a docking cylinder with a baseplate, the locking cylinder is adapted to be fixed to a plug-and-socket connector housing and to a docking cylinder of a closing cap of identical construction, the main axes of symmetry of the locking cylinder and the docking cylinder are aligned with one another, and an outer diameter of the locking cylinder is greater than an outer diameter of the docking cylinder, and the locking cylinder is adapted be fixed in accordance with a bayonet principle to a plug connector housing and/or to a closing cap of identical construction.

2. The closing cap as claimed in claim 1, wherein the closing cap has a seal, which is arranged in a groove provided inside the closing cap.

3. The closing cap as claimed in claim 1, wherein the closing cap is manufactured from plastic.

4. The closing cap as claimed in claim 1, wherein the closing cap is manufactured from transparent plastic.

5. The closing cap as claimed in claim 1, wherein the closing cap has a colored marking.

6. The closing cap as claimed in claim 1, wherein the closing cap has a seal, which is arranged in a groove provided inside the closing cap.

7. The closing cap as claimed in claim 2, wherein the closing cap is manufactured from plastic.

8. The closing cap as claimed in claim 2, wherein the closing cap is manufactured from transparent plastic.

9. The closing cap as claimed in claim 2, wherein the closing cap has a colored marking.

10. The closing cap as claimed in claim 3, wherein the closing cap has a colored marking.

11. The closing cap as claimed in claim 4, wherein the closing cap has a colored marking.

12. The closing cap as claimed in claim 5, wherein the closing cap has a colored marking.

13. The closing cap as claimed in claim 6, wherein the closing cap has a colored marking.

14. The closing cap as claimed in claim 7, wherein the closing cap has a colored marking.

* * * * *